US005620750A

United States Patent [19]

Minoura et al.

[11] Patent Number: 5,620,750

[45] Date of Patent: Apr. 15, 1997

[54] METHOD FOR APPLYING METALLIC COATING

[75] Inventors: Shuji Minoura; Kazuo Nakagawa; Daisuke Nakazono, all of Saitama-ken, Japan

[73] Assignee: Honda Giken Kogyo Kabushiki Kaisha, Tokyo, Japan

[21] Appl. No.: 400,754

[22] Filed: Mar. 8, 1995

[30] Foreign Application Priority Data

Oct. 21, 1994 [JP] Japan ..... 6-257184

[51] Int. Cl.[6] ..... B05D 7/00

[52] U.S. Cl. ..... 427/421; 427/407.1; 427/409; 427/475; 427/477; 427/480; 427/484

[58] Field of Search ..... 427/475, 477, 427/480, 484, 407.1, 409, 421; 239/703

[56] References Cited

U.S. PATENT DOCUMENTS

| | | | |
|---|---|---|---|
| Re. 51,590 | 5/1984 | Mitsui | 427/484 |
| 4,730,020 | 3/1988 | Wilfinger et al. | 524/555 |
| 5,079,030 | 1/1992 | Tomioka . | |

FOREIGN PATENT DOCUMENTS

| | | |
|---|---|---|
| 0147355 | 7/1985 | European Pat. Off. . |
| 59-51868 | 12/1984 | Japan . |
| 63-14917 | 4/1988 | Japan . |
| 5951868 | 12/1988 | Japan . |
| 63-319086 | 12/1988 | Japan . |
| 326371 | 2/1991 | Japan . |
| 2229941 | 10/1990 | United Kingdom . |

OTHER PUBLICATIONS

PTO Translation of JP59–51868.

*Primary Examiner*—Shrive Beck
*Assistant Examiner*—David M. Maiorana
*Attorney, Agent, or Firm*—Weiner, Carrier & Burt, P.C.; Joseph P. Carrier; Irving M. Weiner

[57] ABSTRACT

The disclosed present invention relates to a method of applying a metallic coating, such as a finish paint coating to an automobile. This method comprises two processes or stages using a bell-shaped rotary atomizer and a metallic paint. The amount of paint ejected from the rotary atomizer, shaping air pressure, and coating speed are maintained at approximately the same values during both the first and second processes. In the first process, the peripheral speed of the bell-shaped atomizing head is set within a range of 39 to 65 m/s. In the subsequent second process, the peripheral speed of the bell-shaped atomizing head is set to a lower value than in the first process, that is, within the range of 21 to 39 m/s, and the reduction rate of the nonvolatile (NV) value is set to 3% or more. This method improves the orientation of a bright pigment, enabling the automobile to appear high-grade, and providing a quality metallic coating.

19 Claims, 3 Drawing Sheets

{100−(NV value after second pass/ NV value after first pass)×100}

METHOD FOR APPLYING METALLIC COATING

BACKGROUND OF THE INVENTION

1. Field of the Invention

The present invention relates to a metallic coating method for automobiles, and, in particular, to a method comprising a two step coating (two processes) using a rotary atomizer with a bell shaped atomizing head.

2. Description of the Related Art

Metallic coating is used, for example, for finishing the coating of the body of an automobile. Available metallic paints include those containing a bright pigment such as aluminum flakes or mica. For example, Japanese Published Unexamined Patent Application No. 63-31908 discloses a two step coating technique (comprising two processes) for applying such metallic paints using a rotary atomizer.

With this technique, the plain part of an object to be coated is metallically coated using an electrostatic rotary atomizer, and the modified part of the object which is located at the front and back thereof is then metallically coated using a rotary atomizer with a bell shaped atomizing head. In the conventionally disclosed technique, the amount of paint ejected from the rotary atomizer with a bell shaped atomizing head, the number of rotations of the rotary atomizer, and/or the voltage applied to the rotary atomizer are varied to prevent the bright pigment from having a nonuniform density where metallic coatings overlap each other, and the viscosity of the paint is also adjusted. The adjustment involved in this operation is thus very complicated. Consequently, if the color of the coating is changed for some reason, it is almost impossible to determine what parameter should be adjusted and how that parameter should be adjusted.

This invention is provided to solve this problem.

SUMMARY OF THE INVENTION

This invention is a coating method comprising first and second processes using a rotary atomizer with a bell shaped atomizing head and a metallic paint. The amount of paint ejected from the rotary atomizer, shaping air pressure, and reciprocating coating speed of the rotary atomizer are maintained at approximately the same values during both the first and second processes. In the first process, the peripheral speed of the bell-shaped atomizing head is set within a range of 39 to 65 m/s. In the subsequent second process, the peripheral speed of the bell-shaped atomizing head is set to a lower value than in the first process, that is, within a range of 21 to 39 m/s, and the reduction rate of the nonvolatiles (NV) value is set to 3% or more.

Metallic coating comprising two processes improves the orientation of the bright pigment because the paint film formed in each process is thin. In the first process, a rotary atomizer, for example, 50 mm in diameter of an atomizing head, is operated at a peripheral speed within the range of 39 to 65 m/s, that is, 15,000 to 25,000 rpm. Coating under these conditions enables volatile components such as solvents to be blown away from sprayed paint components to quickly increase the viscosity of the paint, thereby preventing the random movement of the bright pigment such as aluminum flakes to improve its orientation. The bright pigment can be oriented easily during a second pass by stabilizing the hardness of the paint early during the first process.

In the second process, the peripheral speed of the atomizing head for the second pass is set so that the reduction rate of the NV value can be 3% or more. This further improves the orientation of the bright pigment.

In the second process, a rotary atomizer for example, 50 mm in diameter of an atomizing head is operated at a peripheral speed within a range of 21 to 39 m/s, that is, 8,000 to 15,000 rpm. Coating at this peripheral speed provides good orientation for the bright pigment.

Since this invention varies the peripheral speed of the rotary atomizer head between the first and second processes with other parameters maintained at the same values, variations in color tone can be adjusted without special skill or experience, resulting in easy correction of color tones.

This invention also provides a clear coating method that can be carried out after the metallic coating. The above coating with the metallic paint is performed using a rotary atomizer head including a paint ejection end without grooves. The clear coating is performed using a bell-shaped atomizing head including a paint ejection end with a groove. The high viscosity of the clear paint enables it to be efficiently and optimally fractionated and atomized through the grooves when ejected. A quality clear coating can be formed on a quality metallic coating, resulting in a quality overall metallic coating that enables the automobile to appear high-grade. Other objects, advantages and salient features of the invention will be apparent from the following detailed description which, when considered in conjunction with the annexed drawings, discloses preferred embodiments of the invention.

DETAILED DESCRIPTION OF PREFERRED EMBODIMENTS

Figure 1:
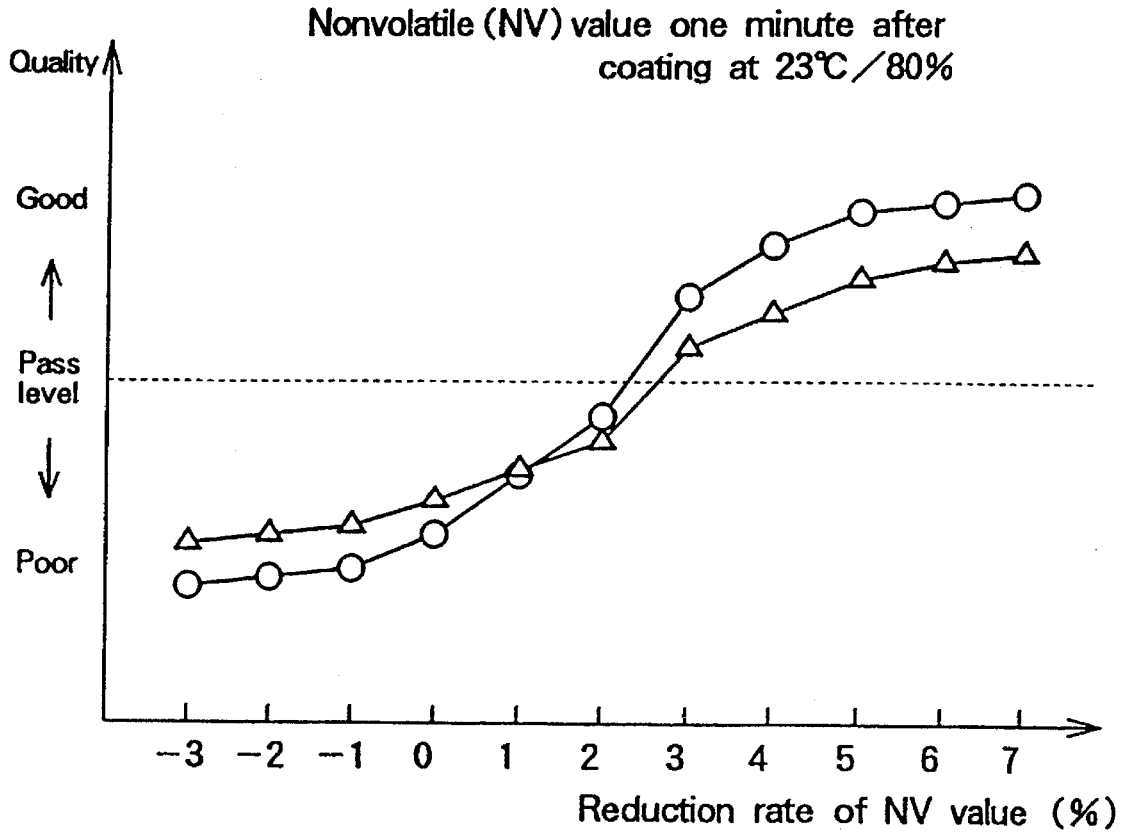
FIG. 1 is a graph showing the results of verification of the relationship between the reduction rate of the nonvolatile (NV) value and the coating quality in two examples.

Preferred embodiments of this invention are described in detail with reference to the accompanying drawings.

In short, this invention is a coating method comprising first and second processes using a rotary atomizer and a metallic paint. The amount of paint ejected from the rotary atomizer, shaping air pressure, and reciprocating coating speed of the rotary atomizer are maintained at approximately the same values during both the first and second processes. In the first process, the peripheral speed of the atomizing head is set within the range of 39 to 65 m/s. In the subsequent second process, the peripheral speed of the bell-like atomization head is set to a lower value than in the first process, that is, within a range of 21 to 39 m/s, and the reduction rate of the nonvolatile (NV) value is set to 3% or more.

The nonvolatile (NV) value is the content of solids in the paint components excluding volatile components, and increases with increasing dryness of the paint. The reduction rate of the NV value is represented by the following equation, and, in this invention, calculated one minute after coating is finished:

Reduction rate of NV value={100–(NV after second pass/NV after first pass)×100}

The rotary atomizer is described below, and has a configuration wherein a atomizing head is rotated at a high speed to effect centrifugal force in order to tangentially eject a paint contained in the middle of the head from the marginal section of head which extends outwardly and circumferentially along the inner surface of the head. Charges are simultaneously applied to the paint, and shaping air is blown from the marginal section of the head. In this manner, coating is carried out while adjusting the coating pattern, enabling coating with a high adhesion.

Metallic coating is characterized by a reversible image that enables the automobile to appear high-grade. It is commonly believed that the orientation of the bright pigment in a paint film is most important to obtain such a reversible image. It is also believed that, in particular, the thickness of the paint film and variations in viscosity due to drying must be controlled to orient the bright pigment. In general, the orientation is easy when the paint film is thin. The orientation of the bright pigment can thus be improved by performing metallic coating comprising two processes wherein a paint film obtained during each process is thin.

In the first process, a rotary atomizer, for example, 50 mm in diameter of an atomizing head is operated at a peripheral speed within the range of 39 to 65 m/s, that is, 15,000 to 25,000 rpm. Coating under these conditions enables volatile components such as solvents to be blown away from sprayed paint components to quickly increase the viscosity of the paint, thereby preventing the random movement of the bright pigment such as aluminum flakes to improve its orientation. The bright pigment can be oriented easily during the second pass by stabilizing the hardness of the paint early during the first process. During the first process, if the peripheral speed exceeds 65 m/s, the bright pigment will have an inappropriate orientation, whereas if the peripheral speed is 39 m/s or lower, the splash of volatile components will be insufficient, resulting in insufficient hardness of the paint to affect the orientation of the bright pigment during the second pass.

In the second process, a rotary atomizer, for example, 50 mm in diameter of an atomizing head is operated at a peripheral speed within the range of 21 to 39 m/s, that is, 8,000 to 15,000 rpm. Coating at this peripheral speed improves the orientation of the bright pigment. If the peripheral speed exceeds 39 m/s, paint particles sprayed against a surface to be coated will be too small to provide sufficient kinetic energy, resulting in inappropriate orientation. If the peripheral speed is 21 m/s or lower, the paint to be sprayed cannot be atomized easily.

In addition, the peripheral speed of the rotary atomizer for a second pass is set so that the reduction rate of the NV value can be 3% or more. This further improves the orientation of the bright pigment. This is probably because the bright pigment applied during the second pass is prevented from slipping under the first layer if the paint applied during the first pass has a certain hardness.

Embodiments of this invention are described in detail below.

A metallic paint used for finishing the coating of automobiles comprises a bright pigment such as aluminum and mica flakes, a metallic pigment consisting of a color pigment, a resin component such as an acrylic resin or a melamine resin, a solvent enabling the paint to be easily coated, and an additive consisting of an ultraviolet ray absorbent, a settling inhibitor, and/or a surface conditioner. Such a paint is coated as a base coat. A clear coat is then coated on this base coat to obtain a reversible image wherein the gloss and the hue vary according to the viewing angle and which allows the automobile to appear high-grade.

The composition of the components of a metallic paint varies depending upon the types of pigment and solvent. For example, a metallic paint may contain 5.2% of metallic pigment, 34.1% of resin, 54.1% of solvent, and 6.6% of additive. The metallic pigment comprises 4% of bright pigment and 1.2% of inorganic or organic color pigment.

The orientation of the bright pigment is most important to obtain such a reversible image that enables the automobile to appear high-grade. It is believed that the thickness of the paint film and variations in viscosity due to drying must be controlled to appropriately orient the bright pigment. In general, the orientation is easy when the paint film is thin, and an appropriate orientation can be obtained by using the nature of the metallic layer such that it normally rapidly increases its own viscosity during drying, to restrain the random movement of the bright pigment.

Metallic coating comprising two processes causes a paint film obtained after each process to be thin, thereby improving the orientation of the bright pigment and the adhesion of the paint. In this case, variations in viscosity must be controlled during each process. This invention thus controls the number of rotations of the atomizing head that may substantially affect variations in viscosity, with other conditions unchanged or virtually unchanged during each process.

The table below shows the results of verification of the adaptability of this invention in terms of colors. For example, silver metallic pigment 1 represented by reference A was coated using a rotary atomizer 50 mm in diameter of an atomizing head that was operated at a specified number of rotations, a specified reciprocating speed (b), and a specified reciprocating stroke width (a) with the amount of paint to be ejected from the atomizer and the applied voltage applied to the atomizer to 65 cc/min and –60 V, respectively. The number of rotations per unit time was varied between the first and the second passes. As shown in this table, the number of rotations was set to 20,000 rpm during the first pass (52 m/s in peripheral speed because the diameter was 50 mm), it was set to 10,000 rpm during the second pass (26 m/s in peripheral speed because the diameter was 50 mm), and a film about 13 μm in thickness was formed.

In the table, reference S/A designates a shaping air pressure and reference HV designates an applied voltage.

In this invention, the number of rotations per unit time for each process was set as follows.

| Paint reference | Paint name | Pigment: Bright pigment | Pigment: Color pigment | Film thickness | Stage | Amount of paint ejected | Number of rotations | S/A | HV | Reciprocating operation: Stroke | Reciprocating operation: Speed | Interval 1st–2nd |
|---|---|---|---|---|---|---|---|---|---|---|---|---|
| A | Silver metallic 1 | Aluminum 4.7% | — | 13 μm | First pass | 65 | 20000 | 1.3 | −60 | a | b | 80 |
| | | | | | Second pass | 65 | 10000 | ↑ | ↑ | ↑ | ↑ | |
| B | Red pearl | Color P 5.9% | 2.8% | 20 μm | First pass | 100 | 20000 | 1.3 | −60 | a | b | ↑ |
| | | | | | Second pass | 100 | 10000 | ↑ | ↑ | ↑ | ↑ | |
| C | Silver metallic 2 | Aluminum 5.6% | 0.4% | 11 μm | First pass | 60 | 20000 | 1.3 | −60 | a | b | ↑ |
| | | | | | Second pass | 60 | 10000 | ↑ | ↑ | ↑ | ↑ | |
| D | Green pearl | White P 2.1% Interference P 1.6% | 4.6% | 12 μm | First pass | 70 | 20000 | 1.3 | −60 | a | b | ↑ |
| | | | | | Second pass | 70 | 10000 | ↑ | ↑ | ↑ | ↑ | |
| E | Green metallic | Aluminum 3.0% | 0.7% | 12 μm | First pass | 70 | 20000 | 1.3 | −60 | a | b | ↑ |
| | | | | | Second pass | 70 | 10000 | ↑ | ↑ | ↑ | ↑ | |
| F | Blue pearl | Interference P 2.8% | 1.5% | 10 μm | First pass | 70 | 20000 | 1.3 | −60 | a | b | ↑ |
| | | | | | Second pass | 70 | 10000 | ↑ | ↑ | ↑ | ↑ | |
| G | Plum pearl | Interference P 1.1% | 1.2% | 12 μm | First pass | 70 | 20000 | 1.3 | −60 | a | b | ↑ |
| | | | | | Second pass | 70 | 10000 | ↑ | ↑ | ↑ | ↑ | |

The number of rotations per unit time of an atomizing head for the first pass should be set to a somewhat large value that does not affect the orientation of the bright pigment so that volatile components such as solvents will be blown away from the paint components to rapidly increase the viscosity of the paint. In this invention, it was set to 15,000 to 25,000 rpm (39 to 65 m/s in peripheral speed). As described above, this is because if the peripheral speed exceeds 65 m/s, the bright pigment will have an inappropriate orientation, whereas if the peripheral speed is 39 m/s or lower, the splash of volatile components will be insufficient, resulting in insufficient hardness of the paint. If the paint film from the first process is insufficiently hard, it obstructs the ability to prevent random movement of the bright pigment, and if such random movement is not prevented it undesirably affects the orientation of the bright pigment during not only the first pass but also the second pass.

During the second pass, the bright pigment must be more precisely oriented because a layer obtained after the second pass will be the upper layer. In this invention, the number of rotations per unit time of an atomizing head was set to a lower value than in the first pass, that is, 8,000 to 15,000 rpm (21 to 39 m/s in peripheral speed). It was also set within such a range that enables a reduction rate of the NV value of 3% or more to be achieved. This is because coating quality increases with the increasing reduction rate of the NV value, as is apparent from the results of verification in FIG. 1.

FIG. 1 is a graph showing the results of verification of the relationship between the reduction rate of the NV value and coating quality in two examples. In the Figure, circles represent the first example, and triangles represent the second example. The vertical axis represents coating quality and the horizontal axis represents the reduction rate of the NV value (%). Both examples demonstrate that coating quality increases with the increasing reduction rate of the NV value and that acceptable quality is obtained when the rate is about 3%. The reduction rate further increased and leveled off after reaching about 6%. Thus, about 3 to 6% of reduction rate is actually preferable. In this case, the NV value was measured one minute after coating was finished at a temperature of 23° C. and a humidity of 80%. For coating quality, the finish conditions of the color tone and the brightness were evaluated using spectral reflectance and color difference.

A low reduction rate of the NV value indicates a small content of solids (that is, the paint film is soft) during the first pass. That is, if the second coating is formed on the soft paint film obtained during the first pass, the sprayed bright pigment may slip under the first layer, resulting in disturbed orientation of the pigment which reduces coating quality. In addition, the paint cannot be atomized easily when the peripheral speed is 21 m/s or lower, and the orientation of the bright pigment does not meet the severe requirement when the peripheral speed is 39 m/s or higher.

Thus, for each color shown in the above table, the number of rotations was set to 20,000 rpm (52 m/s peripheral speed) during the first pass, and to 10,000 rpm during the second pass (26 m/s peripheral speed). The resulting finish state was good in all the cases. Metallic coating with a rotary atomizer tends to result in the inappropriate orientation of the bright pigment and a blackish hue over all of the surface compared to a similar operation with an air spray. It was confirmed, however, that coating with a rotary atomizer under the above conditions produces results as good as with air spray. Such coating is effective because it also provides high adhesion.

This invention adjusts, among various conditions, only the number of rotations per unit time (peripheral speed) of the atomization head of a rotary atomizer with other complicated conditions unchanged or virtually unchanged between the first pass and the second pass. Consequently, if a color tone must be corrected, this invention enables it to be corrected easily without high skill or experience.

In this invention, when a rotary atomizer is used for metallic coating comprising two processes, only the number of rotations per unit time (peripheral speed) of the atomizing head of the rotary atomizer is adjusted within the specified range described above, and this number of rotations per unit time (peripheral speed) is used to adjust the reduction rate of the NV value within the specified range as described above. Other, more complicated conditions, including the amount of paint ejected, shaping air pressure, and reciprocating coating speed of the rotary atomizer are maintained at the same or approximately the same values during both processes. This has enabled good quality coating. If a color tone changes, it can be corrected and adjusted easily. As described above, metallic coating has conventionally been carried out by an air spray coater, and a clear coating has subsequently been formed on the metallic-coated surface. The clear coating has been executed by a rotary atomizer with a bell-shaped atomizing head.

This is to improve the adhesion of the clear paint. This invention also includes a process for forming a clear coating on a metallic-coating film obtained by an efficient metallic coating operation with a bell-shaped atomizing head under the above conditions.

That is, a clear coating is formed on the metallic coating film formed on the surface of the body of an automobile by metallic coating with a bell-shaped atomizing head under the above conditions. The rotary atomization head of a rotary atomizer similar to the one used in metallic coating as well as a clear paint are used to perform wet-on-wet clear coating to form a clear coating film on a metallic-coating film.

Figure 2:
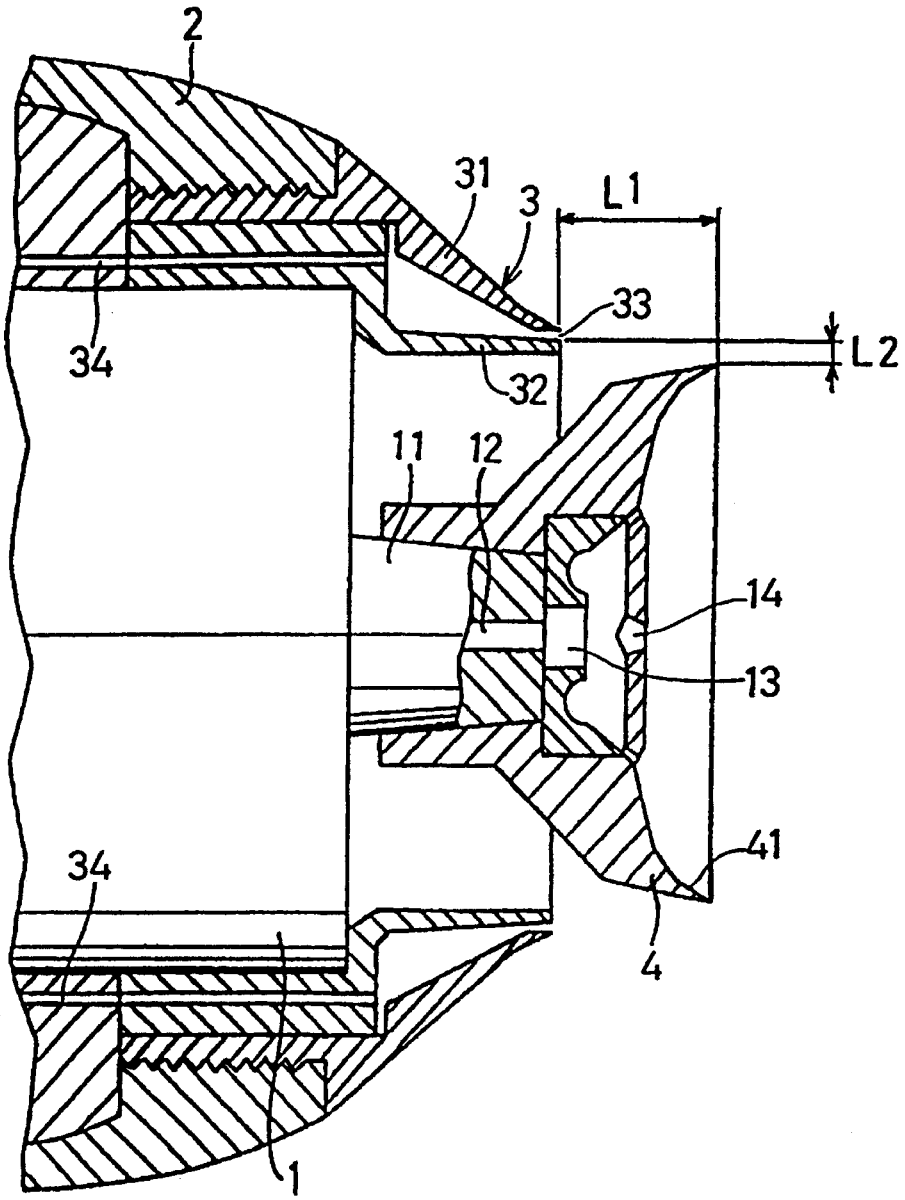
FIG. 2 is a partially enlarged longitudinal section of the head section of a rotary atomizer without grooves.
Figure 4:
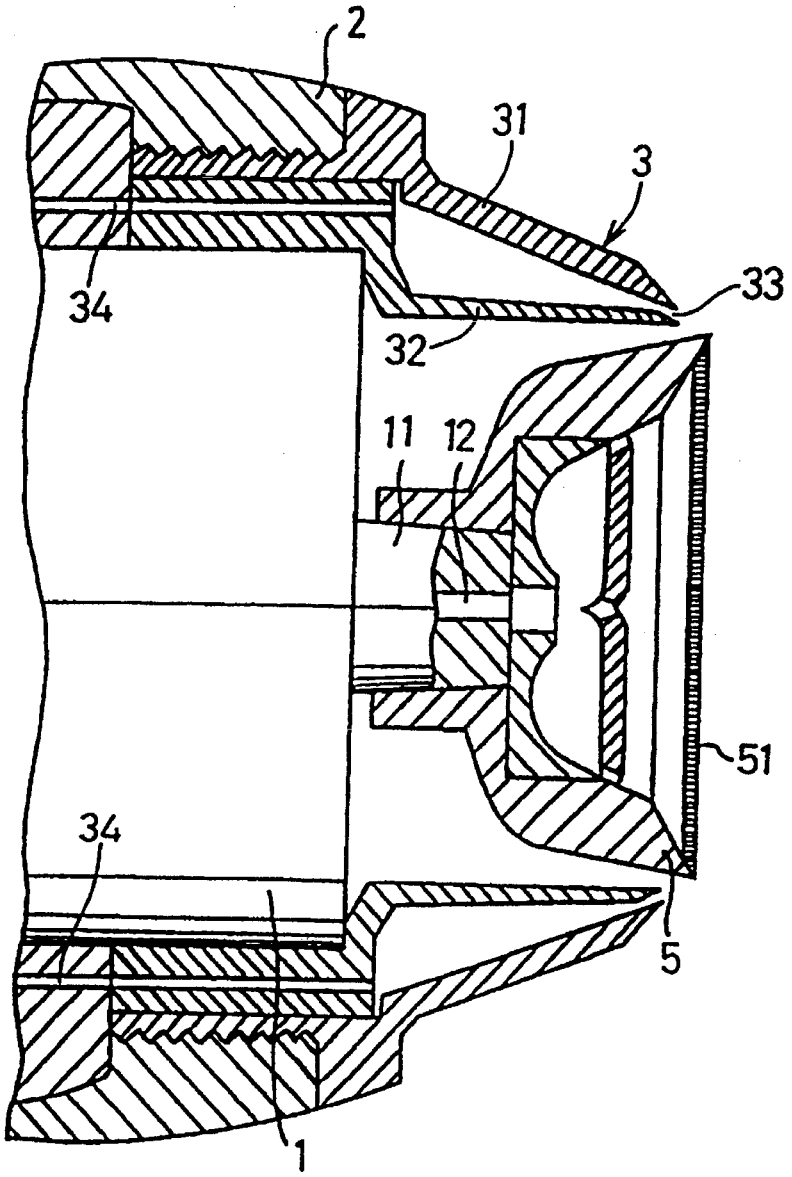
FIG. 4 is a partially enlarged longitudinal section of the head section of a rotary atomizer with grooves.

The bell-shaped atomizing head of a rotary atomizer used for metallic and clear coating according to this invention preferably has the configuration shown in FIGS. 2 and 4.

Figure 3:
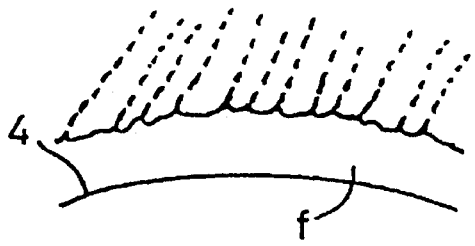
FIG. 3 describes paint ejected from the head section of the rotary atomizer in FIG. 2.

FIG. 2 shows a partially enlarged longitudinal section of the head of a rotary atomizer without grooves, and FIG. 3 describes paint ejected from the head of the rotary atomizer in FIG. 2.

This atomizing head comprises an air turbine 1 and a casing 2 installed outside the air turbine and having a built-in high-voltage generator (not shown). The casing 2 has at its tip a nozzle 3 comprising inner and outer nozzle sections 31 and 32. A ring-like shaping air exhaust pore 33 at the tip of the nozzle 3 communicates with a high-pressure air passage 34 axially drilled in the periphery of the casing 2 to receive supplied shaping air. Shaping air jetted from the exhaust pore 33 is used to form a coating pattern.

The rotation shaft 11 of the air turbine 1 has a bell-shaped atomizing head 4 secured to its tip, and a paint supply passage 12 axially drilled therein. The paint supply passage 12 communicates with the supply pores 13, 14 in the center of the atomizing head 4 to supply a paint from the atomization head 4. An inner circumferential face 41 at the paint ejection end at the tip of the atomizing head 4 has a larger diameter at the tip and comprises a smooth ring-like slope without grooves. The axial length L1 and the radial length L2 between the ejection end of the atomizing head 4 and the air nozzle 3 are set to 10 to 20 mm and 0.5 to 3 mm, respectively.

FIG. 3 describes a paint ejected from the atomizing head 4. As shown in the Figure, a paint is ejected in the form of a film due to the interaction among the rotation of the atomizing head 4, supply of the paint, and jetting of shaping air. The paint splashes from the film-like material (f) and is atomized into relatively large particles. At this point, shaping air is sprayed against the film-like material (f). The progress of the shaping air is, however, obstructed by the particles, which in turn gain great kinetic energy to increase their flying speed.

As a result, excess volatile components such as solvents in the paint are blown away to rapidly increase the viscosity of the paint, as described above. This configuration can thus restrain the random movement of the bright pigment in the paint such as aluminum flakes to improve its orientation. In addition, in an embodiment wherein the metallic coating comprises two processes using the bell-shaped atomizing head 4 under the above conditions, coating at a high rotational speed during the first process forces volatile components in the paint such as solvents to be splashed and removed, increases the viscosity of the paint, and restrains the random movement of the bright pigment to improve its orientation. Consequently, the hardness of the paint can be stabilized early during the first process, and the bright paint for the second pass can be oriented easily during the second process performed at a lower rotational speed than in the first process.

A rotary atomizer with such an atomizing head without grooves is thus used for metallic coating.

Figure 5:
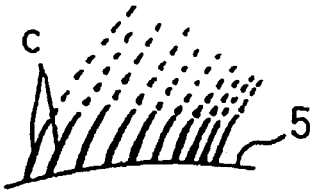
FIG. 5 describes a paint ejected from the head section of the rotary atomizer in FIG. 4.

FIG. 4 is a partially enlarged longitudinal section of the head section of a rotary atomizer with grooves, and FIG. 5 describes a paint ejected from the head section of the rotary atomizer in FIG. 4.

This atomizer has the same configuration as the above rotary atomizer except the atomizing head, so like components carry corresponding reference numerals and the description is omitted. This atomizing head 5 has a large number of grooves 51 axially formed like rings all over the inner circumferential face of the tip of the head which acts as a paint ejection end.

Since this atomizing head 5 has grooves 51 at the paint ejection end, paint flowing along the inner circumferential face of the atomizing head 5 in the form of a film is atomized through these grooves 51. As a result, as shown in FIG. 5, the paint is atomized and ejected from the ejection end of the atomizing head 5 as a large number of cusps (c).

As shown in FIG. 5, the atomizing head 5 with grooves is used for clear coating because this coating involves high viscosity. Thus, in clear coating, particles become too large, and this trend is significant if the number of rotations (peripheral speed) of the atomizing head is small, resulting in degraded smoothness and coating defects such as the presence of bubbles in a coating obtained. The atomizing head 5 with grooves 51 at its paint ejection end prevents the formation of extremely fine particles and the presence of bubbles in a coating obtained to improve the quality of clear coating. Clear coating is preferably performed using the atomizing head 5 with grooves at a high rotational speed.

The results of experiment for clear coating with the atomizing head 5 with grooves after metallic coating are shown below. In the experiment, metallic coating was applied under the above conditions, and a clear coating was then formed on the metallic coating film. For clear coating, the voltage applied was the same as in the metallic coating, the shaping pressure was 1.0 kg/cm$^2$, the amount of clear paint ejected was, for example, 300 cc/min, and a film 40 μm in thickness was formed.

When the number of rotations of the atomizing head was 15,000 rpm, the smoothness was somewhat poor, some bubbles were present in the coating obtained, the color tone was good, and the total performance was somewhat poor. When the number of rotations of the atomizing head was increased to 30,000 to 40,000 rpm, the smoothness was good, no bubbles were present in the coating obtained, the color tone was good or very good, and the total performance was good or very good.

For metallic coating, a bell-shaped atomizing head without grooves of a rotary atomizer thus provides quality coating when the head is operated at a relatively low rotational speed (peripheral speed), and in two stages or processes, under the above conditions.

For the subsequent clear coating, a bell-shaped atomizing head with grooves provides quality coating to further improve the quality of the metallic coating obtained.

Since the number of rotations of the bell-shaped atomizing head for metallic coating is relatively small, the life of the rotation mechanism of the atomizing head is prolonged, thereby simplifying maintenance for the rotary atomizer.

We claim:

1. A metallic coating method comprising first and second processes using a rotary atomizer with a bell-shaped atomizing head to apply a metallic paint, wherein an amount of said metallic paint ejected from the rotary atomizer, a shaping air pressure, and a reciprocating coating speed of the rotary atomizer are maintained at the same or approximately the same values for both the first and second processes; and wherein a peripheral speed of the bell-shaped atomizing head during the first process is higher than that during the second process, and a reduction rate of a nonvolatile (NV) value is maintained at at least 3%.

2. A metallic coating method according to claim 1 wherein the peripheral speed of the bell-shaped atomizing head during the first process is set within a range of 39 to 65 m/s.

3. A metallic coating method according to claim 1 wherein the peripheral speed of the bell-shaped atomizing head during the second process is set within a range of 21 to 39 m/s.

4. A metallic coating method according to claim 1 wherein the reduction rate of the NV value is 3 to 6%.

5. A metallic coating method according to claim 1, including a further step of applying clear coating after said metallic coating using a rotary atomizer with a bell-shaped atomizing head having a number of grooves axially formed at a paint ejection end thereof.

6. A metallic coating method according to claim 5 wherein a bell-shaped atomizing head without grooves is used to apply said metallic coating during both the first and second processes, and said clear coating applying step is a wet-on-wet clear coating step performed after the first and second processes.

7. A metallic coating method according to claim 2 wherein the reduction rate the NV value is 3 to 6%.

8. A method of forming a metallic coating on an object, comprising the steps of:

applying metallic paint to form a first film on an object, using a rotary atomizer having a bell-shaped atomizing head, in a first pass;

applying the metallic paint to form a second film on the first film, using the rotary atomizer having the bell-shaped atomizing head, in a second pass;

a peripheral speed of the bell-shaped atomizing head during the first pass is in a range of 39–65 m/s; and a peripheral speed of the bell-shaped atomizing head during the second pass is in a range of 21–39 m/s.

9. A method according to claim 8, wherein a reduction rate of a nonvolatile value (NV) one minute after coating, at 23° C. and 80% relative humidity, is at least 3%.

10. A method according to claim 9, wherein the reduction rate is in a range of 3–6%.

11. A method according to claim 8, wherein an amount of paint ejected from the rotary atomizer, a shaping air pressure, and a reciprocating coating speed of the rotary atomizer are maintained at substantially identical values during the first and second passes.

12. A method according to claim 8, wherein an interval between said first and second passes is approximately 80 s.

13. A method according to claim 8, further including a step of applying clear coating on said second film with the rotary atomizer having another bell-shaped atomizing head, said another bell-shaped atomizing head having a number of grooves axially formed at a paint ejection end thereof.

14. A method according to claim 8, wherein a paint ejection end of said bell-shaped atomizing head has a smooth, grooveless inner circumferential face.

15. A method according to claim 13, wherein a paint ejection end of said bell-shaped atomizing head for applying the metallic paint has a smooth, grooveless inner circumferential face.

16. A method according to claim 1, wherein an interval between said first and second processes is approximately 80 s.

17. A metallic coating method according to claim 5, wherein a peripheral speed of said grooved, bell-shaped atomizing head during said clear coating step is at least as high as a peripheral speed of the bell-shaped head applying said metallic paint during said first process.

18. A metallic coating method according to claim 17, wherein the peripheral speed of the bell-shaped atomizing head during the first process is in the range of 15,000–25,000 rpm, and the peripheral speed of the grooved, bell-shaped atomizing head during the clear coating is set within a range of 30,000–40,000 rpm.

19. A metallic coating method according to claim 13, wherein a peripheral speed of said grooved, bell-shaped atomizing head during said clear coating step is at least as high as a peripheral speed of the bell-shaped head applying said metallic paint during said first process.

* * * * *

UNITED STATES PATENT AND TRADEMARK OFFICE

CERTIFICATE OF CORRECTION

PATENT NO. : 5,620,750

DATED : April 15, 1997

INVENTOR(S) : Shuji Minoura, Kazuo Nakagawa, Daisuke Nakazono

It is certified that error appears in the above-indentified patent and that said Letters Patent is hereby corrected as shown below:

Column 4, line 29, after "layer", insert a comma.

Column 9, line 14, after the period insert --Although there have been described what are at present considered to be the invention, it will be understood that variations and modifications can be made thereto without departing from the scope or essence of the invention. The scope of the invention is indicated by the appended claims.

Signed and Sealed this

Twenty-fourth Day of June, 1997

Bruce Lehman

*Attest:*

BRUCE LEHMAN

*Attesting Officer*

*Commissioner of Patents and Trademarks*